US006641429B1

(12) United States Patent
Wu

(10) Patent No.: US 6,641,429 B1
(45) Date of Patent: Nov. 4, 2003

(54) ELECTRICAL CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/210,118

(22) Filed: Jul. 31, 2002

(51) Int. Cl.[7] ..... H01R 13/58
(52) U.S. Cl. ..... 439/465; 439/610
(58) Field of Search ..... 439/460, 465, 439/585, 369, 610

(56) References Cited

U.S. PATENT DOCUMENTS 4,842,547 A 6/1989 Defibaugh et al.
4,921,441 A * 5/1990 Sauder ..... 439/460
5,108,313 A * 4/1992 Adams ..... 439/610
5,167,523 A * 12/1992 Crimmins et al. ..... 439/350
5,195,909 A 3/1993 Huss, Jr. et al.
6,203,375 B1 * 3/2001 Chang ..... 439/607

* cited by examiner

*Primary Examiner*—Tho D. Ta
*Assistant Examiner*—James R. Harvey
(74) *Attorney, Agent, or Firm*—Wei Te Chung

(57) ABSTRACT

An electrical cable assembly (1) comprises a back shell (10) defining a pair of receiving slots (16), an electrical cable (20) received in the back shell, a strain relief member (30) for compression the cable in the back shell, and a back shell cover (40) coupled to the back shell. The strain relief member has a bight portion (32) overridden the electrical cable and a pair of legs (34) depending downward from the bight portion for insertion into the receiving slots. Each leg forms a plurality of burrs (35) on a single lateral side (37) thereof for being interferingly engaged with the back shell, thereby a relative small insertion force on the strain relief is needed.

2 Claims, 10 Drawing Sheets

ELECTRICAL CABLE ASSEMBLY

CROSS-REFERENCE TO RELATED APPLICATION

This application is a co-pending application of U.S. Patent Applications with unknown serial numbers and entitled "ELECTRICAL CONNECTOR" and "ELECTRICAL CONNECTOR WITH IMPROVED STRAIN RELIEF", both invented by the same inventors, assigned to the same assignee. The disclosures of the applications are wholly incorporated herein by reference.

BACKGROUND OF THE INVENTION

1. Field of the Invention

The present invention relates to an electrical cable, and particularly to an electrical cable having a strain relief member.

2. Description of Prior Art

As the demands for high bandwidth and low latency in computer technology increases, the emerging InfiniBand™ architecture is being developed by the information industry. InfiniBand architecture de-couples an I/O subsystem from memory by utilizing point-to-point connections rather than a shared bus. InfiniBand products are ideally suited for clustering, I/O extension, and native attachment in many network applications and can be used in high-performance server applications, providing a cost-effective transition from existing technologies.

When a cable or the like is terminated by an electrical connector, a strain relief means is needed to minimize force placed on a cable of the electrical connector, and such strain relief means are disclosed in U.S. Pat. Nos. 4,842,547, 5,195,909 and 5,383,796. Good strain relief terminated to a cable requires a proper compression to the cable while holds the cable firmly. U.S. Pat. No. 4,842,547 issued to AMP Corporation on Jun. 27, 1989, discloses a strain relief 30 which has a bight 52 and two legs 54, 56 extending there from the bight 52. Each of the legs 54, 56 includes a plurality of burrs 66 formed on opposite side edges thereof. After the strain relief 30 is inserted into a connector housing 12 to a predetermined position, the cable 36 is compressed into a remaining space between the strain relief 30 and an abutment surface 32 of the connector housing 12. However, the burrs 66 are in penetrating contact with engagement surfaces 42, 44 of the connector housing 12, which causes a relative large insertion force on the strain relief 30. Additionally, once an electrical cable with a relative large diameter replaced the cable 36, the strain relief 30 alone can not provide enough compression force to effectively retain the electrical cable in place.

Hence, an electrical cable assembly having an improved strain relief means is desired to overcome the disadvantages of the prior art.

BRIEF SUMMARY OF THE INVENTION

A first object of the present invention is to provide an electrical cable assembly having a strain relief means which is easily and reliably mounted to a back shell thereof;

A second object of the present invention is to provide an electrical cable assembly having a strain relief means which provides an enough compression force for an electrical cable thereof.

To fulfill the above-mentioned objects, an electrical cable assembly in accordance with the present invention comprises a back shell, an electrical cable, a strain relief member for compression the cable in the back shell, and a back shell cover coupled to the back shell. The back shell defines a chamber and a receiving port communicated with the chamber and forms a pair of receiving slots beside the receiving port. The electrical cable has a plurality of insulated conductors received in the chamber and an insulator packing the insulated conductors. The insulator forms a metal braiding received in the receiving port of the back shell. The strain relief member has a bight portion overridden the metal braiding of the electrical cable and a pair of legs depending downward from the bight portion for being received into the receiving slots. Each leg forms a plurality of burrs on a single lateral side thereof for interferingly fitted with the receiving slot to thereby securely compression the electrical cable in the receiving port.

Other objects, advantages and novel features of the invention will become more apparent from the following detailed description of the present embodiment when taken in conjunction with the accompanying drawings.

DETAILED DESCRIPTION OF THE INVENTION

Figure 1:
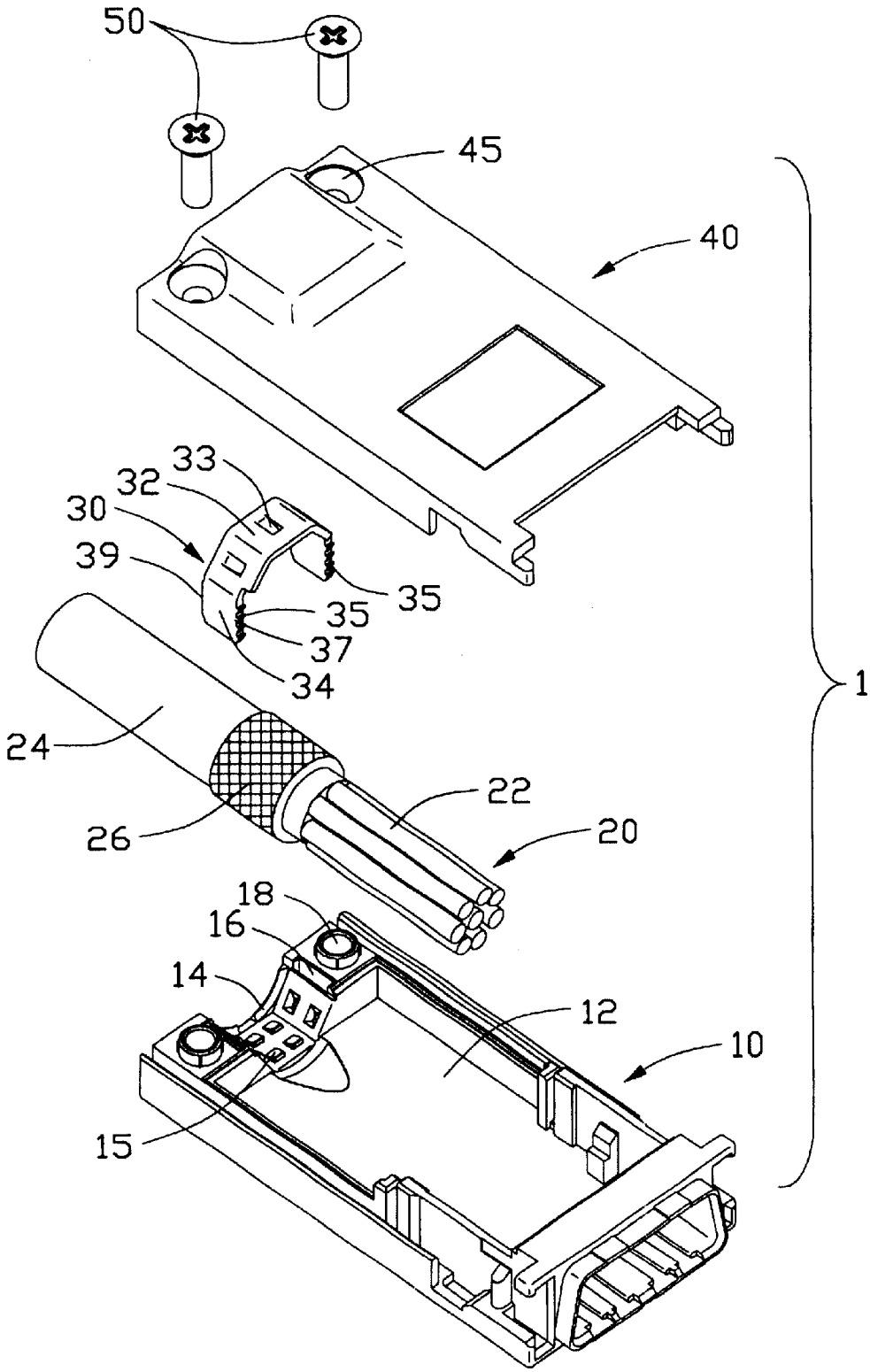
FIG. 1 is an exploded view of an electrical cable assembly in accordance with a first embodiment of the present invention.
Figure 2:
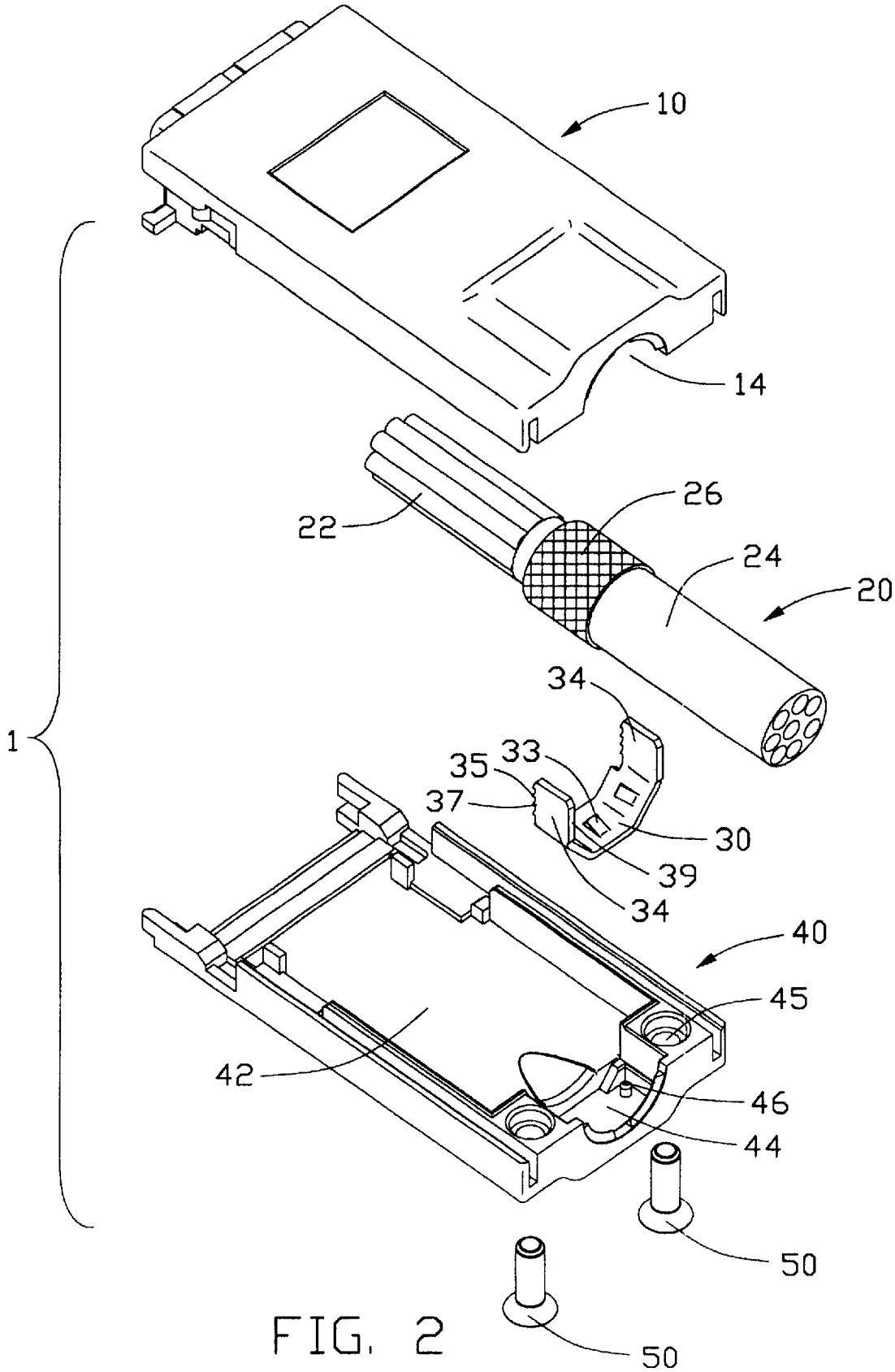
FIG. 2 is a view similar to FIG. 1 from a bottom aspect.
Figure 3:
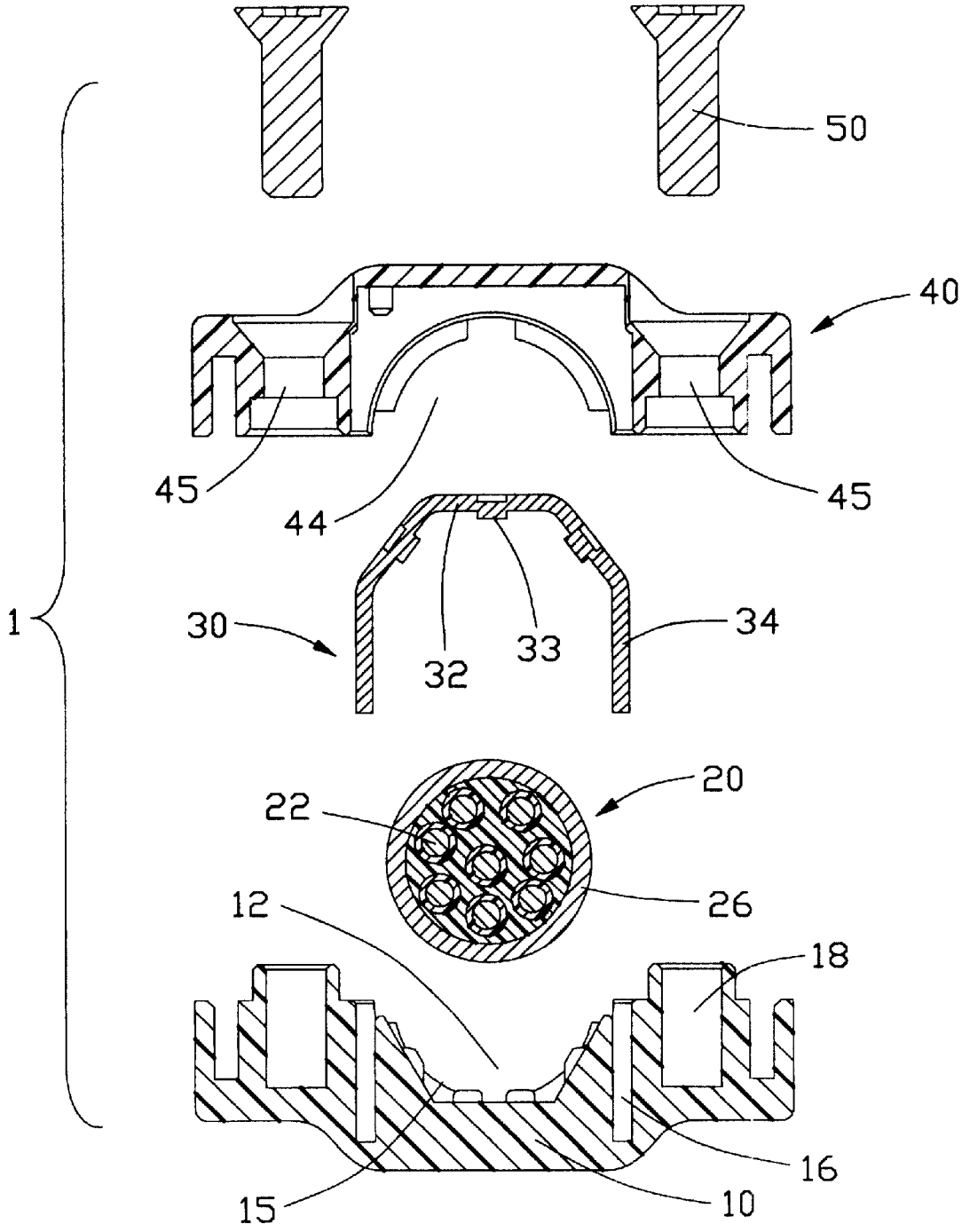
FIG. 3 is a cross-sectional view of FIG. 1.
Figure 4:
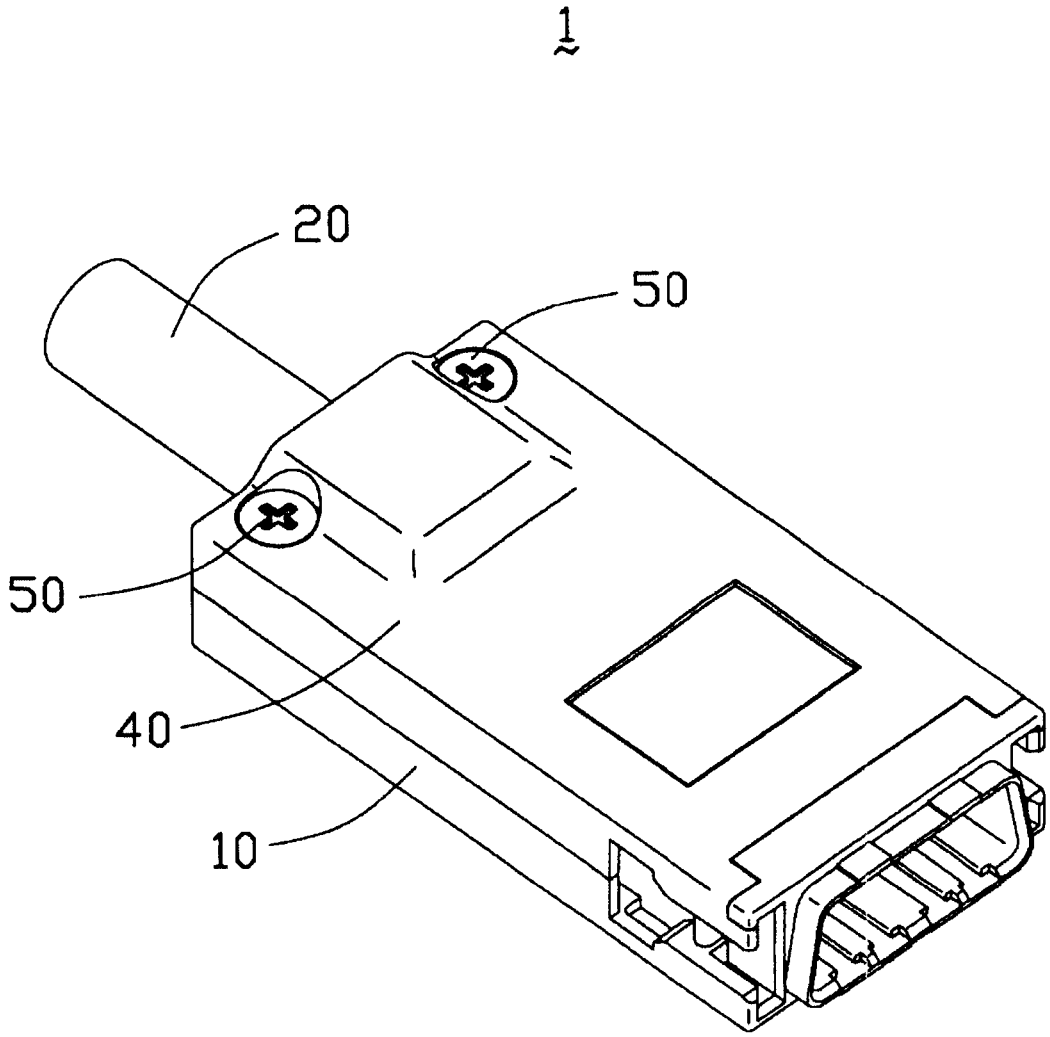
FIG. 4 is an assembled view of FIG. 1.
Figure 5:
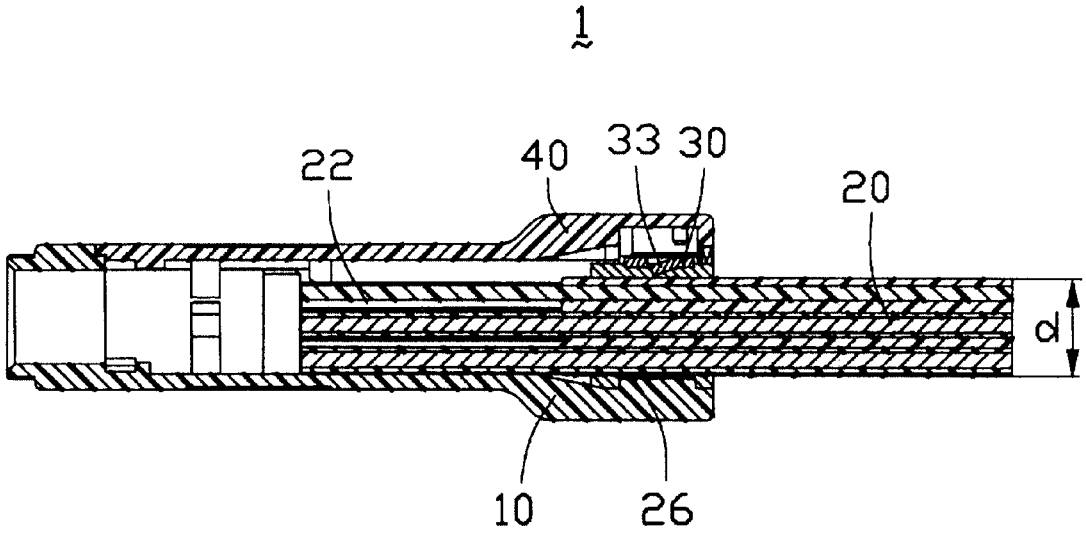
FIG. 5 is a cross-sectional view of FIG. 4.

Reference will now be made to drawings, and particularly to FIG. 1, an electrical cable assembly 1 in accordance with a first preferred embodiment of the present invention comprises a back shell 10, an electrical cable 20 received in the back shell 10, a strain relief member 30, a back shell cover 40 and a pair of screws 50 coupling the back shell cover 40 to the back shell 10.

A detailed description of the back shell 10, the back shell cover 40 as well as the screws 50 is detailedly described in the co-pending applications which are incorporated herein by reference.

The back shell 10 and the back shell cover 40 define a lower chamber 12 and an upper chamber 42, respectively, for cooperatively enclosing the cable 20 therebetween. Additionally, the back shell 10 and the back shell cover 40 respectively define a lower receiving port 14 communicated with the lower chamber 12 and an upper receiving port 44 communicated with the upper chamber 42, respectively. The lower receiving port 14 forms a plurality of bosses 15 upwardly extending for abutting against the electrical cable 20. A pair of receiving slots 16 are defined beside the receiving port 14 by the back shell 10. Furthermore, the upper receiving port 44 forms a pair of posts 46 (only one shown) at a pair of diagonal corners thereof.

The electrical cable 20 forms a plurality of insulated conductors 22 received in the lower chambers 12 of the back shell 10 for electrically connecting to the adapter device described in the co-pending application, and an insulator 24 packaging the insulated conductors 22. The cable further forms a metal braiding 26 packaging on the insulator 24 to be clamped between the lower and upper receiving ports 14, 44 of the back shell 10 and the back shell cover 40.

Figure 6:
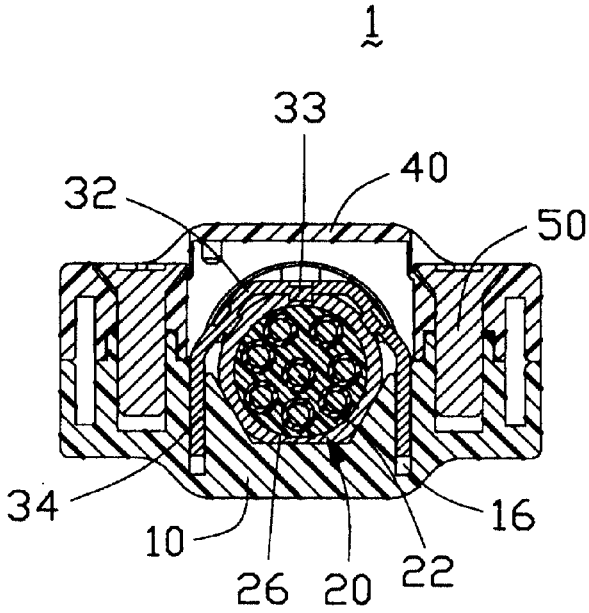
FIG. 6 is another cross-sectional view of FIG. 4.
Figure 7:
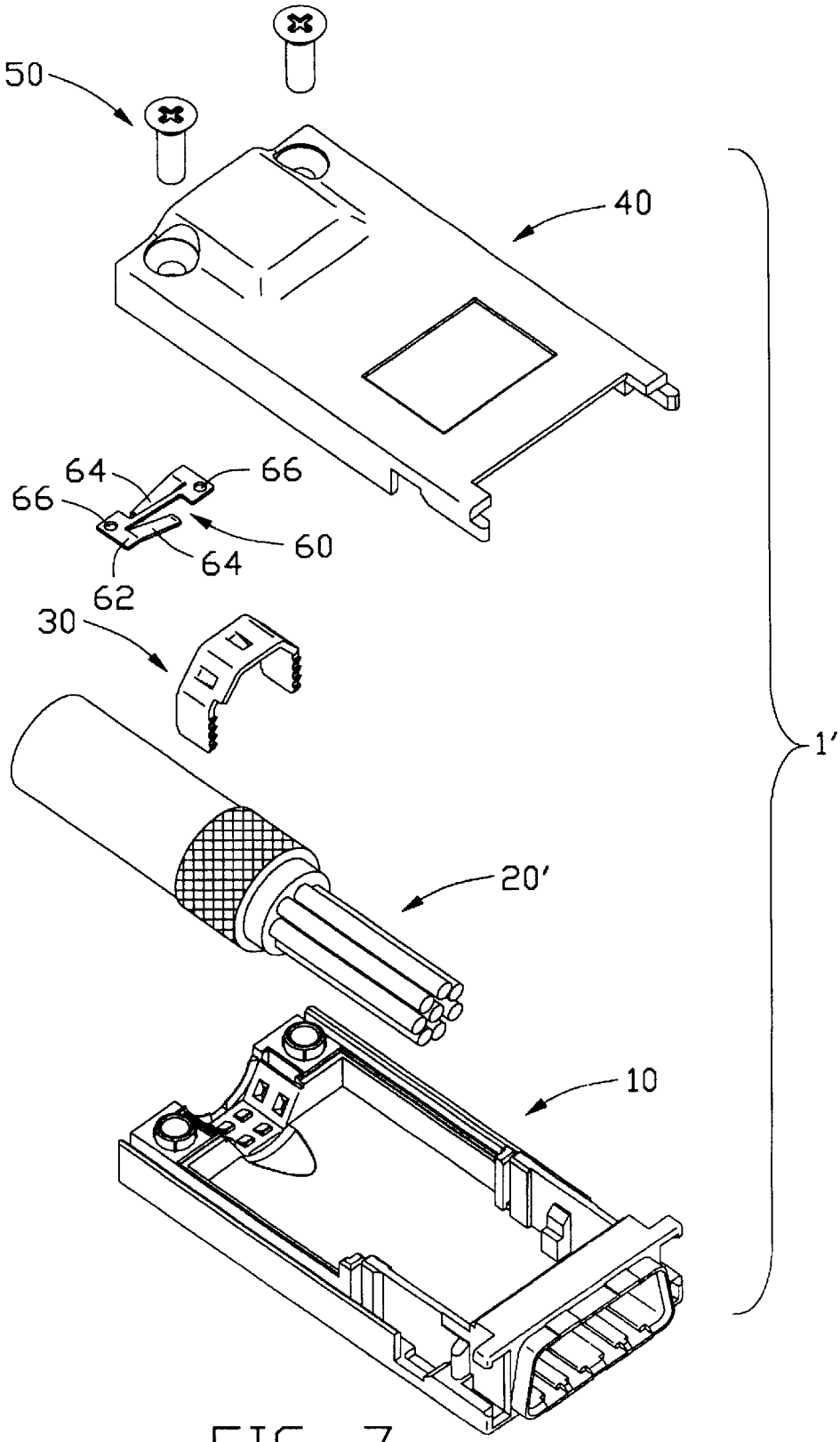
FIG. 7 is an exploded view of an electrical cable assembly in accordance with a second embodiment of the present invention.
Figure 8:
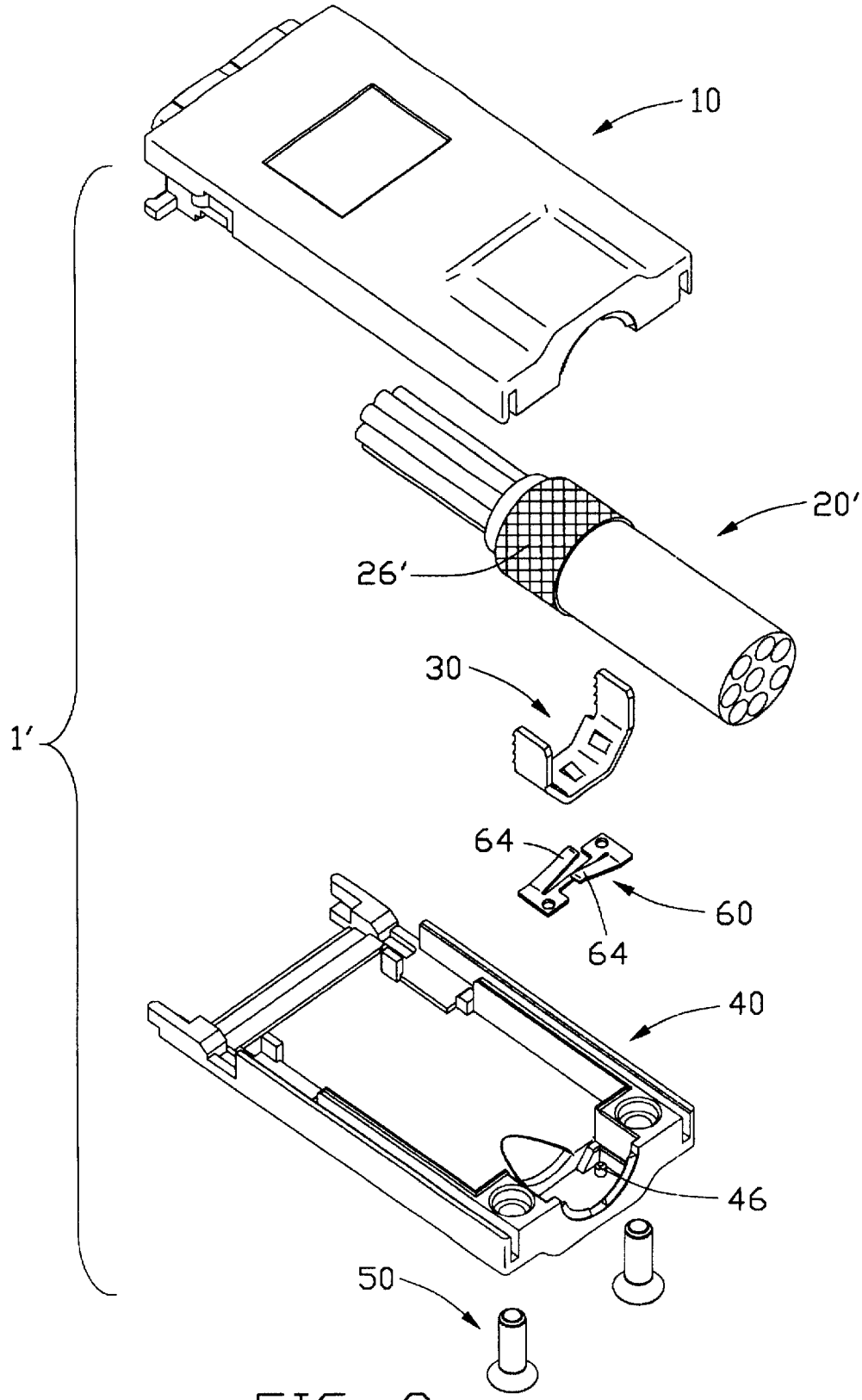
FIG. 8 is a view similar to FIG. 7 from a bottom aspect.

The strain relief member 30 is substantively in a "U" shape and has a bight portion 32 and a pair of legs 34 depending downward from the bight portion 32. The bight portion 32 is adopted for overriding on the metal braiding 26 of the cable 20. The bight portion 32 further forms several retaining tabs 33 downward extending for biting into the metal braiding 26 to retain the cable 26 in position (see FIG. 6). The leg 34 is received into a corresponding receiving slot 16 of the back shell 10 and forms a plurality of burrs 35 on a single side edge 37 thereof. The other side edge 39 opposite to the side edge 37 of each leg 34 has a flat surface for easy insertion of the leg 34 into the corresponding receiving slot 16.

Further referring to FIGS. 3 to 6, in assembly, the cable 20 is put into the lower chamber 12 of the back shell 10 and the metal braiding 26 thereof is received in the lower receiving port 14. The bight portion 32 of the strain relief member 30 is overridden on the metal braiding 26 and the retaining tabs 33 are bitten into the metal braiding 26 to retain the cable 20 in place. Additionally, the pair of legs 34 of the strain relief member 30 are inserted into corresponding receiving slots 16 of the back shell 10. Meanwhile, the burrs 35 of the legs 34 are interferingly fit with corresponding slots 16 of the back shell 10, which rigidly resists forces tending to pull the cable 20 out. The back shell cover 40 is then mounted on the back shell 10. At last, the screws 50 pass through corresponding apertures 45 defined by the back shell cover 40 and into corresponding holes 18 defined by the back shell 10 to thereby coupling the back shell cover 40 to the back shell 10.

Referring to FIGS. 7 to 12, the electrical cable assembly 1' in accordance with the second embodiment of the present invention is shown. It is noted that the same components of the cable assembly 1' as those of the cable assembly 1 of the first embodiment of the present invention are referenced by the same numbers. The electrical cable assembly 1' comprises a back shell 10, a cable 20', a strain relief member 30, a back shell cover 40, a pair of screws 50 and a pushing member 60 added with respect to the electrical cable assembly 1 of the first embodiment.

The cable 20' is similar to the cable 20 in structure except that it has a larger diameter "D" than that "d" of the later. Thus, it is relatively difficult to reliably compress the cable 20' in the back shell 10, and the pushing member 60 is thus developed to solve the difficulty as will be detailed described below.

The pushing member 60 is stamped and formed from a metal sheet and has a body plate 62 and a pair of resilient tabs 64 extending downward from opposite sides of the body plate 62. Additionally, A pair of through holes 66 are defined at a pair of diagonal corners of the pushing member 60 for fitting with the posts 46 of the back shell cover 40.

Figure 9:
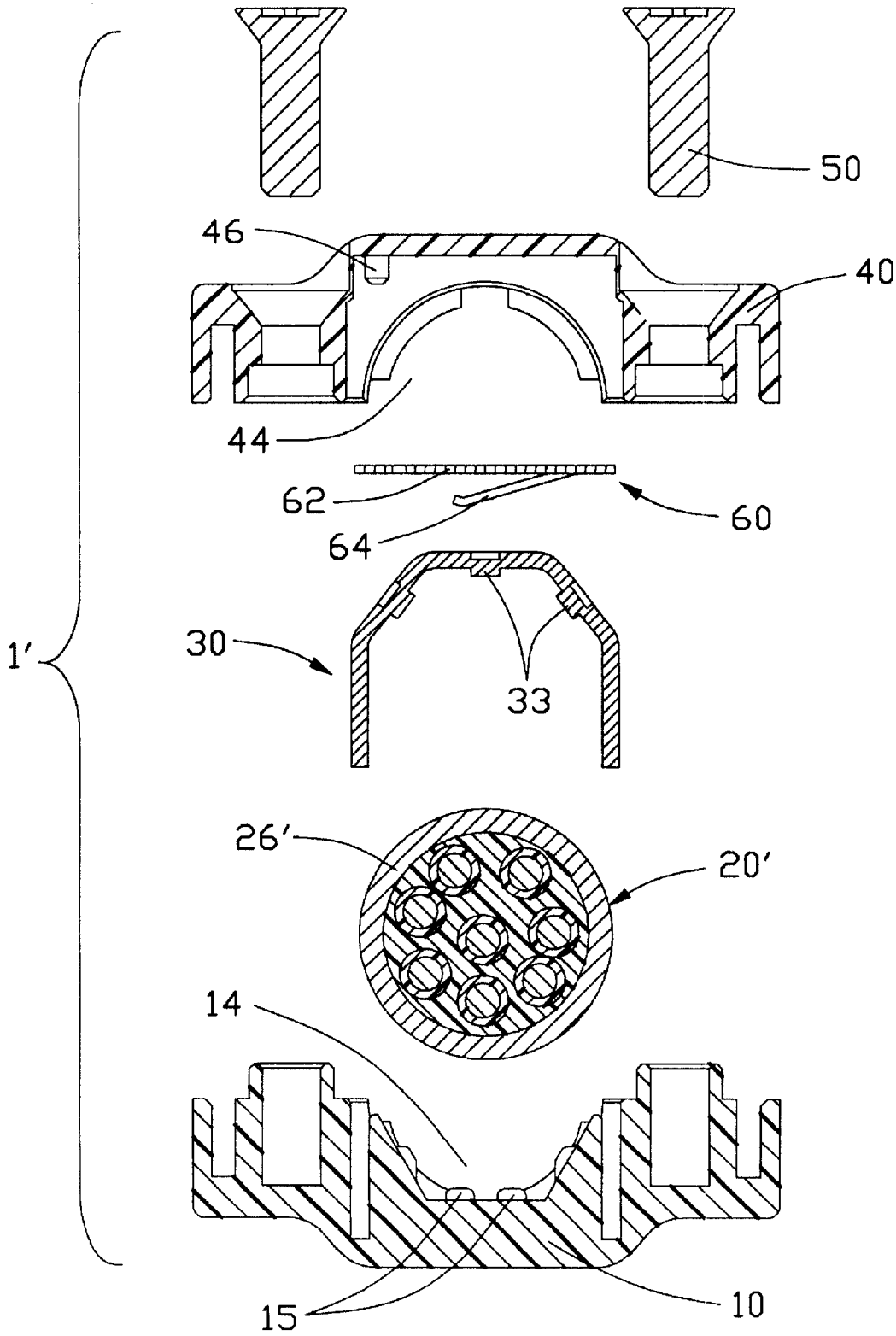
FIG. 9 is a cross-sectional view of FIG. 7.
Figure 10:
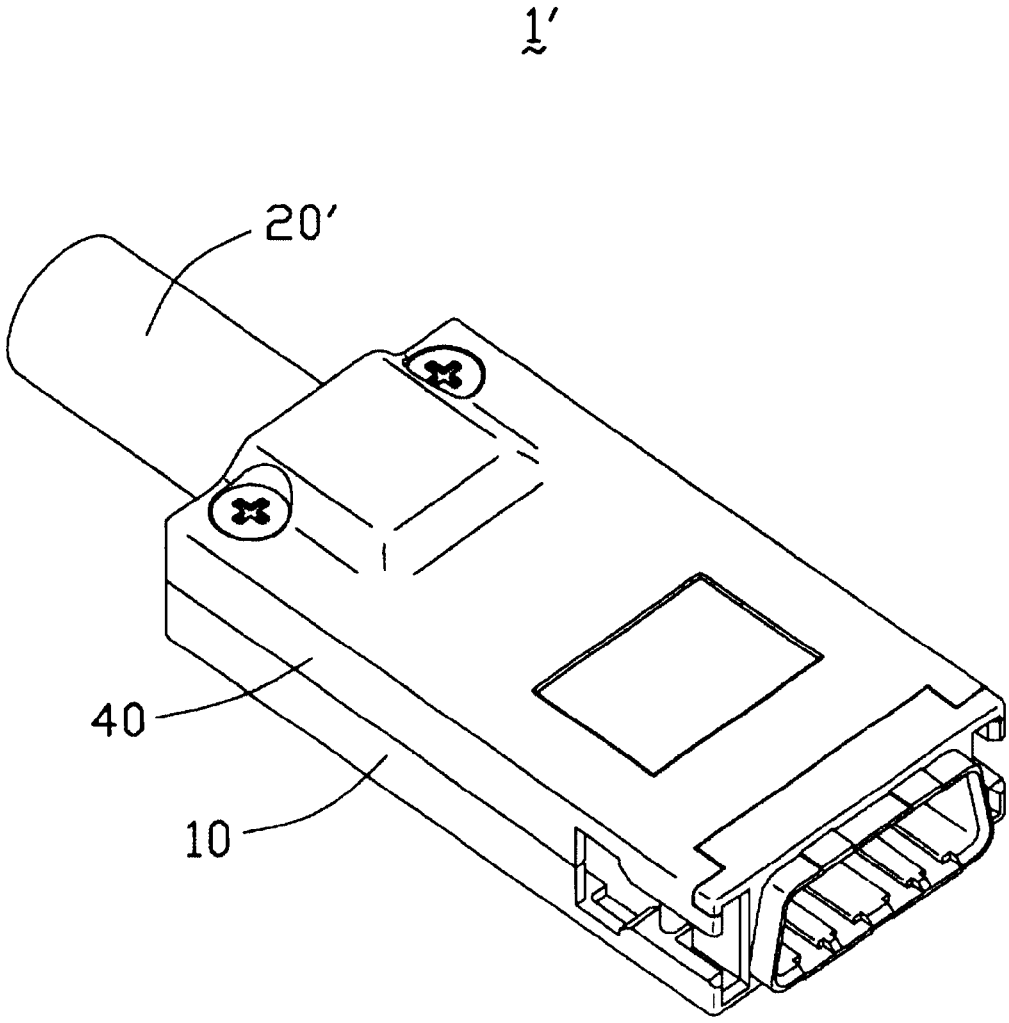
FIG. 10 is an assembled view of FIG. 7.
Figure 11:
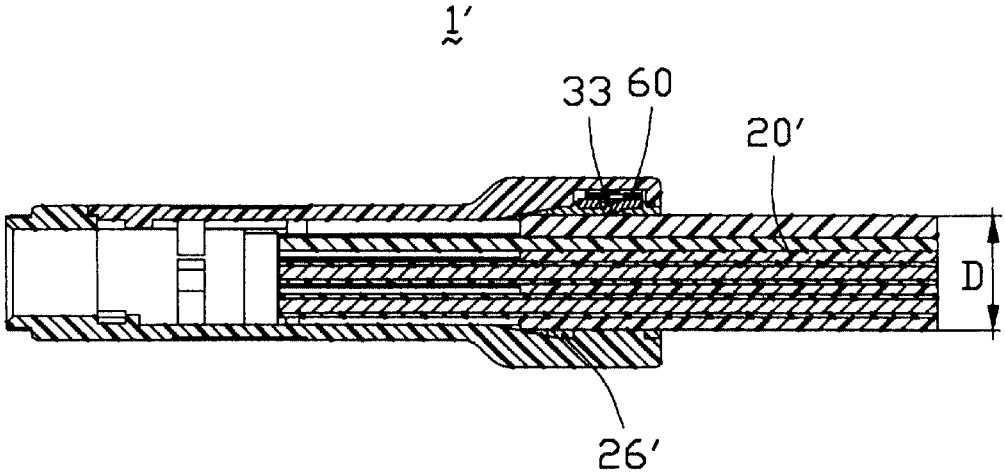
FIG. 11 is a cross-sectional view of FIG. 11.
Figure 12:
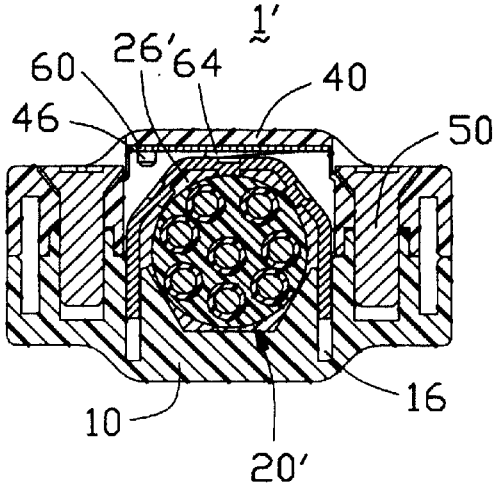
FIG. 12 is another cross-sectional view of FIG. 10.

Further referring to FIGS. 9 to 11, the assembly of the electrical cable assembly 1' is similar to that of the electrical cable assembly 1 of the first embodiment except that the pushing member 60 is fitted with corresponding post 46 of the back shell cover 40 before the back shell cover 40 is mounted on the back shell 10. Then, the back shell cover 40 is coupled to the back shell 10 by the screws 50. Meanwhile, the resilient tabs 64 of the pushing member 60 push against the bight portion 32 of the strain relief member 30 to thereby compressing the metal braiding 26' of the cable 20' in the lower receiving ports 14of the back shell 10, cooperating with the retaining tabs 33 of the strain relief member 30 and the bosses 15 of the lower receiving port 14. Thus, the cable 20' is reliably hold between the back shell 10 and the back shell cover 40 without moving or shaking to thereby securing an reliable electrical connection with the adapter device inserted into the back shell 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable assembly comprising:

a back shell defining a chamber and a pair of receiving slots at one end thereof, an electrical cable having a plurality of insulated conductors received in the chamber and an insulator packaging the insulated conductors;

a strain relief member having a bight portion and a pair of legs depending downward from the bight portion for being received into the receiving slots, each leg forming a plurality of burrs on a single lateral side thereof for being interferingly engaged with the receiving slot of the back shell; and a back shell cover coupled to the back shell;

wherein the electrical cable forms a metal braiding packaging the insulator, and wherein the back shell further defines a receiving port between the pair of receiving slots receiving the metal braiding;

wherein the bight portion of the strain relief member is overridden on the metal braiding of the electrical cable and forms a plurality of retaining tabs biting into the metal braiding of the electrical cable;

wherein another lateral side opposite to the single side of the each leg of the strain relief member has a flat surface for easily insertion of the leg into the corresponding receiving slot;

wherein the receiving port of the back shell forms a plurality of bosses for abutting against the metal braiding of the electrical cable;

wherein the back shell cover defines an aperture and the back shell defines a receiving hole aligned with the aperture;

wherein a screw passing through the aperture into the receiving slot for coupling the back shell cover to the back shell.

2. An electrical cable assembly comprising:

a back shell defining a chamber and a pair of receiving slots at one end thereof;

an electrical cable having a plurality of insulated conductors received in the chamber and an insulator packaging the insulated conductors;

a strain relief member having a bight portion and a pair of legs depending downward from the bight portion for being received into the receiving slots;

a pushing member pushing against the strain relief member to thereby compress the electrical cable in the receiving port, cooperating with the strain relief member; and a back shell cover coupled to the back shell;

wherein each leg of the strain relief member forms a plurality of burrs on a single later side thereof for interferingly engaging with the receiving slot of the back shell;

wherein another lateral side opposite to the single lateral side of the leg of the strain relief member has a flat surface for easy insertion of the leg into the corresponding receiving slot;

wherein the pushing member is stamped and formed from a metal sheet and has a body plate and a pair of resilient tabs extending downward from the body plate for pressing against the strain relief member;

wherein the body plate of the pushing member defines a pair of through holes and wherein the back shell cover forms a pair of posts inserted into the through holes of the pushing member.

* * * * *